United States Patent [19]

Hursh et al.

[11] Patent Number: 4,615,188

[45] Date of Patent: Oct. 7, 1986

[54] TWO-PLY ATHLETIC SOCK

[75] Inventors: David F. Hursh; Lahaska, Pa; James B. Johnston; Frank Ko, both of Philadelphia, Pa.; Jeffrey W. Bruner, Guilderland, N.Y.

[73] Assignee: Foster-Boyd, Inc., Lahaska, Pa.

[21] Appl. No.: 657,461

[22] Filed: Oct. 3, 1984

Related U.S. Application Data

[63] Continuation of Ser. No. 234,171, Feb. 13, 1981.

[51] Int. Cl.[4] ..... D04B 7/04

[52] U.S. Cl. ..... 66/196; 2/239; 66/202; 66/178 R

[58] Field of Search ..... 2/239; 66/178 R, 185, 66/186, 187, 196, 202

[56] References Cited

U.S. PATENT DOCUMENTS

| | | | |
|---|---|---|---|
| 709,734 | 9/1902 | Bellis | 66/196 |
| 1,018,134 | 2/1912 | Scott | 66/196 |
| 1,434,941 | 11/1922 | Boyd | 66/178 X |
| 2,144,563 | 1/1939 | Davis | 66/185 |
| 2,746,054 | 5/1956 | Heilbronner | 2/83 |
| 2,879,634 | 3/1959 | Evans | 60/176 |
| 3,107,510 | 10/1963 | Manger | 66/185 |
| 3,113,570 | 2/1963 | Holliday | 122/284 |
| 3,259,915 | 7/1966 | Dison | 2/236 |
| 3,307,379 | 3/1967 | Wolley et al. | 66/178 |
| 3,510,882 | 5/1970 | White | 2/239 |
| 3,796,067 | 3/1974 | East | 66/178 |
| 4,047,400 | 9/1977 | Thorneburg | 66/171 |
| 4,341,096 | 7/1982 | Safrit et al. | 66/185 |

FOREIGN PATENT DOCUMENTS

| | | | |
|---|---|---|---|
| 2454766 | 12/1980 | France | 66/178 R |

OTHER PUBLICATIONS

Wignall, "Hosiery Technology, Nat. Ktd. Outer Wear Assoc., 1968, N.Y. p.63.

*Primary Examiner*—Ronald Feldbaum
*Attorney, Agent, or Firm*—Paul & Paul

[57] ABSTRACT

A knit sock, especially for jogging or other athletic activity, has a foot portion consisting of a first inner layer or ply disposed inside a second outer layer or ply. The first ply of the foot portion has an inner surface adapted to contact the skin formed principally of yarns having high frictional characteristics, high thermal conductivity, and low moisture regain (hydrophobic). Its opposed surface is formed principally of yarns having relatively low frictional characteristics. The second ply has an inner surface which has low frictional characteristics and its outer surface is formed of yarns having relatively high frictional characteristics and high moisture regain (hydrophilic). The latter surface may also be formed with terry loops to enhance its shock-absorbing construction as well as to increase its moisture absorbing capacity.

11 Claims, 7 Drawing Figures

TWO-PLY ATHLETIC SOCK

This application is a continuation of application Ser. No. 234,171, filed 2-13-81.

BACKGROUND OF THE INVENTION

A. Field of the Invention

This invention relates to socks in general and in particular to a two-ply sock construction of improved construction for athletic activity such as jogging.

B. Prior Art

Since the advent of the jogging craze, there has been an ever-increasing emphasis upon the comfort of the jogger by designing improved shoes and socks. This design is also directed toward reducing the physical toll on the feet and legs of the jogger. Toward this end, various types of sock constructions have been patented or sold which purport to offer superior comfort, greater foot-ease, greater shock-absorbency, and other advantages.

U.S. Pat. No. 3,250,095 to Bird is directed toward a sock of a single ply having inside terry loops made of hydrophilic yarns and outside hydrophobic and elastic yarns. Bird states that this construction will hold perspiration away from the skin of the wearer yet provide good thermal insulating qualities by providing air spaces between the terry loops on the inside of the sock. This, asserts Bird, prevents the yarns from matting or packing down during use which would thereby destroy the thermal insulating and softness characteristics of the socks.

U.S. Pat. No. 3,796,067 issued to East is a two-ply sock knitted in a single operation with terry loops on both the inner and outer surfaces for comfort, warmth and durability. It is a tubular sock which theoretically could be worn inside out, if desired.

Other double ply athletic socks are available commercially, but they are bulky and tend to bunch causing abrasion, blisters, or discomfort. Another jogging sock is made of pure silk in two layers but, while this may be comfortable, silk is known to have much less durability than synthetic fabrics and is much more costly as well as more difficult to launder.

Another sock is made of pima cotton and therefore does not have the heat conductivity or possess the durability of synthetic fabrics.

Still other single ply and double ply sock constructions have been marketed for athletic or jogging use, but they fail to attain the numerous objects that are accomplished by the present invention.

Among these objects of the present invention are the provision of:

(1) An athletic sock which gives the wearer a feeling of great foot ease.

(2) An athletic sock which prevents undue build-up of heat and moisture on the foot of the wearer.

(3) An athletic sock in which relative motion between the sock and the foot is reduced.

(4) An athletic sock wherein relative movement of the foot within the sock in use does not produce "bunching" of the sock material.

(5) An athletic sock with all of the above-enumerated advantages as well as attaining increased shock absorbency.

SUMMARY OF THE INVENTION

A double ply sock whose inner layer has its surface next to the foot formed to have high friction characteristics and its outer surface to have low friction properties. The inner surface of the outer ply also has low friction properties whereas its outer surface has high friction characteristics. In one form, the low friction surfaces of the sock are hydrophobic whereas the outermost surface of the outer ply is hydrophilic and shock absorbing if desired.

DETAILED DESCRIPTION OF THE INVENTION

Figure 2:
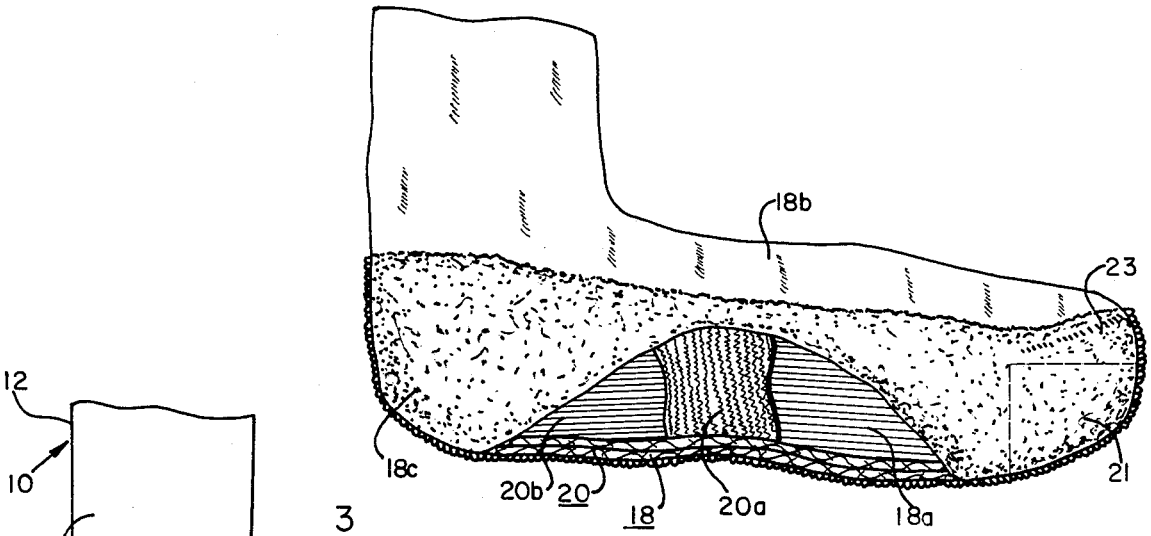
FIG. 2 is a fragmentary, enlarged view of part of the sock shown in FIG. 1, partly broken away to show the surface construction of the layer.
Figure 1:
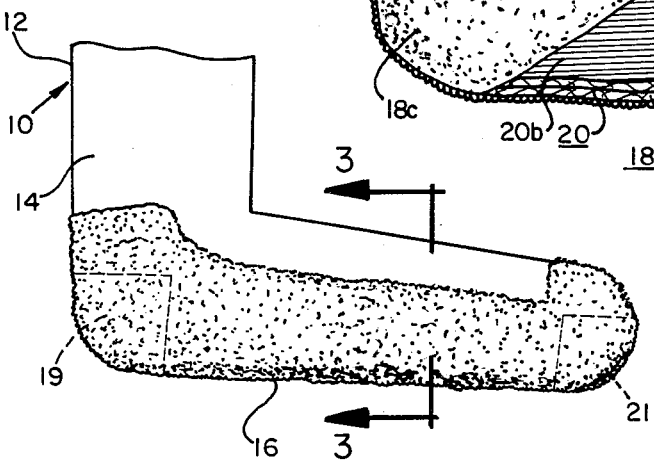
FIG. 1 is a side elevation view of a sock in accordance with the present invention.
Figure 3:
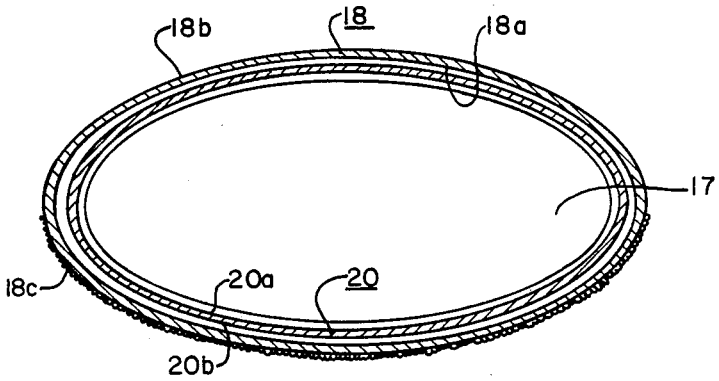
FIG. 3 is a cross-sectional view of the sock construction taken along section line 3—3 of FIG. 2.
Figure 5A:
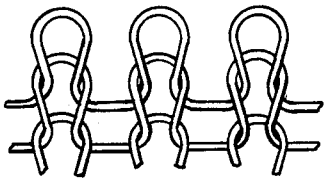
FIGS. 5A and 5B show typical knit patterns that may be used to form the two layer of the sock described herein.
Figure 5B:
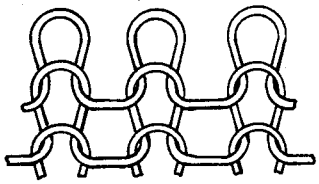
Figure 6:
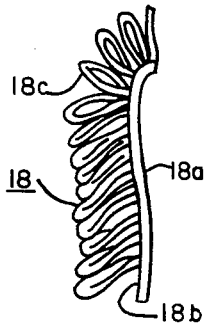
FIG. 6 shows terry loops that may be formed on the outer surface of part of the outer layer of the novel sock according to the present invention.

Referring to FIGS. 1–3, an athletic sock 10 made in accordance with our invention is shown. It has an upper cuff portion 12, a leg portion 14 and a foot portion indicated generally at 16. In one preferred embodiment, it has an outer ply 18 inside of which an inner ply 20 is disposed. To facilitate manufacture of such a two-ply sock, the inner ply 18 can be made slightly smaller than the outer ply 20. In the embodiment shown, inner ply 20 has a relatively high frictional inner surface **20*a* adapted to be placed next to the skin of the wearer. This first surface may be the so-called "technical back" of a plain or jersy knit (FIG. 5B) formed of texturized polypropylene yarns. In simple terms, the "technical back" is the rougher side of a fabric such as may be seen by comparing the inner surface of a man's conventional sock with the smoother outer surface which is known as the "technical face" (FIG. 5A). The technical face is characterized by the fact that the arms of the new stitch are disposed on top of the previously-formed loop. The technical back (FIG. 5B**), to the contrary, has its arm passing below the tops of the loops of the previously knitted stitches.

Since the technical back is much rougher, it will maintain considerable frictional cohesiveness with the skin of the foot so that it will not tend to slip and hence tend to bunch up during use. Being made of polypropylene, this inner ply is highly hydropholic relative to cotton, silk, or wool, for example. It is also characteristic of polypropylene that it has high thermal conductivity so that heat from the foot is conducted away from it. Furthermore, polypropylene has a high level of air permeability relative to cotton and wool, for example, so as to enable the foot to be cooler by allowing air to circulate thus promoting evaporation of moisture.

The outer surface **20*b* of the inner layer is the smoother technical face of the jersey knit which cooperates with a similar smooth inner surface 18*a* of the outer ply 18 so that the foot inner ply moves slidingly as a unit against the outer ply 18 thereby tending to reduce blisters and fabric bunching. The inner surface 18***a* of the outer layer can be constituted by the technical face of a texturized polypropylene jersy fabric. It has been found experimentally that technical face-to-technical face rubbing of texturized polypropylene single knit fabrics produces considerably less friction than face-to-face rubbing of wool-wool, silk-silk, nylon-nylon, and acrylic-acrylic.

The outer surface 18*b* of the outer layer 18, in the portions of the foot section on which terry loops 18*c* are not shown, may be the technical back of the polypropylene jersey fabric. In the other portions shown at the numeral 18*c*, there is provided a fabric having shock-absorbing, hydrophilic, and high frictional characteristics relative to the inside of the shoe so as to prevent sliding of that layer within the shoe. All of these objectives may be accomplished by providing on the sole, on the top of the toe, on the back of the heel or ankle cuff, terry loops 18*c* made of a hydrophilic material such as cotton or wool. The length of the terry loops 22 is a matter of design, but should be sufficient to hold normal amounts of perspiration, should provide good shock absorbency, should minimize the likelihood of bunching, and should not make the sock too bulky. If the terry loops are located on the instep they may tend to trap heat so it may be advantageous to omit them there.

In the form of the invention just described, the inner ply was made of a single knitted material, but the desired characteristics of this layer may be attained by using two different materials to form a composite layer. For example, the composite fabric can include an inner surface made of 150 denier wool yarns (not worsted) on which texturized polypropylene is plated which produces a high friction surface next to the skin whereas the outer surface which is in contact with the inner surface of the outer ply has the desired low friction characteristics.

The yarns of both layers may, in either of the two embodiments discussed, be 150–180 denier which will produce highly satisfactory results. The density or tightness of the fabrics used for the layers may be, for example,

FABRIC TESTS

In choosing possible yarns for incorporation into our invention, various factors were taken into account. Among them were thermal conductivity, air permeability, moisture regain, durability, and frictional characteristics.

As stated above, it is desired that higher frictional characteristics be incorporated into the fabric of the inner layer. Various fabrics and knits were tested after wetting and being squeezed at 20 lbs. pressure to simulate the sweating of the foot. Furthermore, the friction tests were made with those fabrics stretched biaxially (12% longitudinally, 50% transversely) to simulate the tension that the foot exerts upon the sock materials. Measurements of friction were made on a constant-rate-of-elongation tensile tester with one sock stretched on an upper frame on which a 500 gram load was placed. The frame was attached by a line to a pulley and then to a load cell. The other fabric was stretched on a panel or board below the frame. The tests were performed at 60 millimeters per minute. The various fabrics were tested in several ways, i.e., one technical face rubbing against the technical face of the other fabric, one technical back against the technical back of another, and the technical face or back against rubber to simulate the contact of the layer with the shoe and with the foot.

Tables A and B summarize some of the test results of friction tests of fabric face against fabric face and fabric back against fabric back, respectively.

TABLE A

| Face-to-Face | In g/cm$^2$ | Against Rubber |
|---|---|---|
| Cotton | 4.28 | 16.76 |
| Acrylic | 3.71 | 20.00 |
| Wool | 3.21 | 19.22 |
| Silk | 3.16 | 19.38 |
| Nylon | 2.65 | 17.98 |
| Polypropylene (texturized) | 1.58 | 20.31 |

TABLE B

| Back-to-Back | In g/cm$^2$ | Against Rubber |
|---|---|---|
| Polypropylene (texturized) | 5.12 | 21.09 |
| Cotton | 5.09 | 19.69 |
| Nylon | 4.76 | 19.38 |
| Acrylic | 4.26 | 21.71 |
| Silk | 4.09 | 21.90 |
| Wool | 3.27 | 20.31 |

Tables A and B indicate that, in general, the friction of the sock fabric is higher when tested back against back than when rubbed face against face. When tested against a rubber surface, polypropylene and acrylic fabrics tend to have higher friction. When the fabrics are identical, the friction is lower especially when the fabrics were tested face to face. It is seen that the polypropylene fabric shows the lowest level of frictional drag.

Another characteristic of the fabrics to be used in the socks in the air permeability (breathability) of the fabric. Table C shows that polypropylene and silk fabrics tested have higher levels of air permeability in the following descending order:

TABLE C

| |
|---|
| Polypropylene |
| Silk |
| Nylon |
| Cotton |
| Acrylic |
| Wool |

The thermal conductivity of the fabrics tested on a Frayer air permeability tester is shown in Table D in descending order.

TABLE D

| | λ/k cal/m h/°C. |
|---|---|
| Polypropylene | .19–.26 |
| Nylon 6 | .18–.29 |
| Cotton | .061–.063 |
| Wool | .045–.047 |
| Acrylic | .044 |
| Silk | .043–.047 |

Still another parameter that is important is the durability for abrasion resistance of the various fabrics. Based upon the results in Table E, the following were found to have decreasing durability:

TABLE E

| | Work Factor |
|---|---|
| Polypropylene | .85 |
| Nylon | .80 |
| Wool | .71 |
| Silk | .66 |
| Cotton | .49 |
| Acrylic | .40 |

Table F tabulates the relative moisture regain of the fabrics from which the following list of fabrics ranging from the most hydrophobic to the most hydrophilic is extracted. (Calculated at 20° C., 65% relative humidity).

TABLE F

| | % |
|---|---|
| Polypropylene | 0 |
| Acrylic | 1.-2. |
| Nylon | 4.1 |
| Cotton | 7.8 |
| Silk | 10. |
| Wool | 14.-18. |

MANUFACTURE OF SOCK

Figure 4:
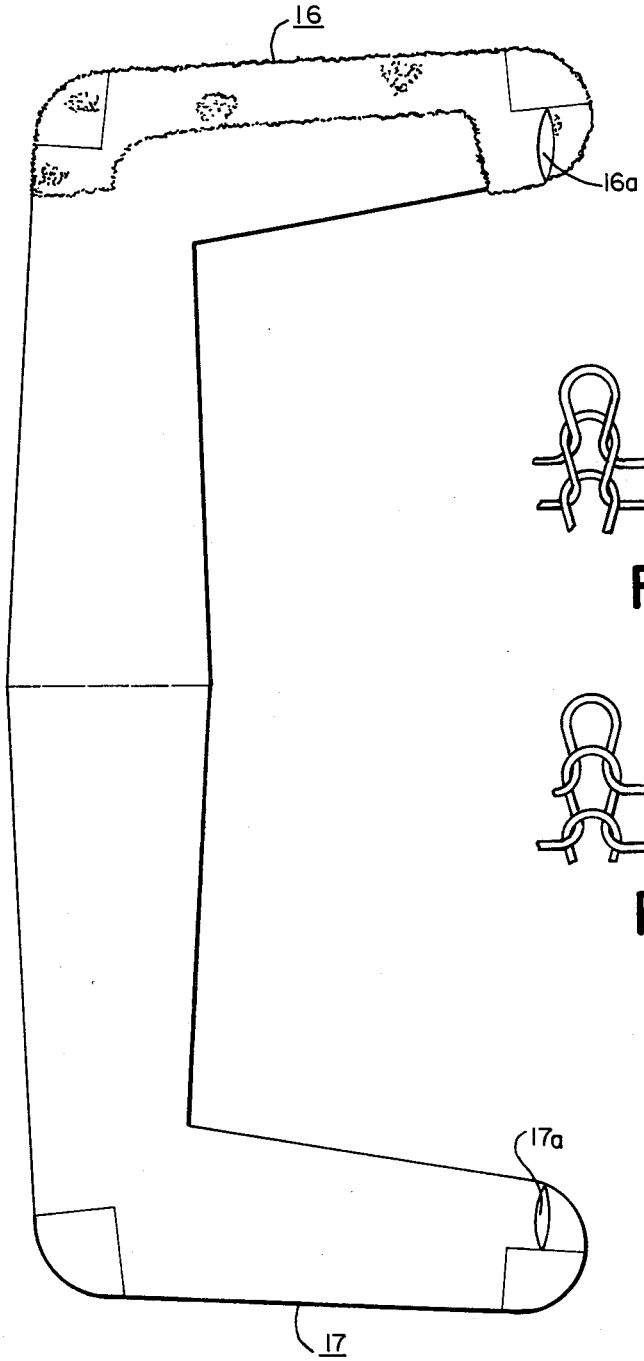
FIG. 4 is a side elevation view of the sock blank at one stage of its manufacture.

The sock may be knit upon a circular knitting machine, single cylinder type, such as Model "Concept T.S." produced by Crawford or on the Speizman Carolina, Model Amy or the Catawba Valley Machinery Company Model CVCS. As shown in FIG. 4, the sock may initially be knit in the form of a double sock toe-to-toe starting with foot portion 16 and continuing to the leg portions and finally to lower foot portion 17. Heel and toe portions 19 and 21 may be knitted for reenforcement in conventional style. The size of the upper sock should be slightly larger to facilitate the insertion of the lower one into it. For better fit and hence less likelihood of slipping or bunching, the leg-foot relation of each such part should be formed as close to 90° as possible as this conforms to the natural stance of the foot relative to the leg when exercising.

The sock would come off the knitting machine in one layer and would have openings 16*a* and 17*a* in the opposite regions. Closure or attachment of the toe sections to one another should preferably be done so that it is seamless, i.e., there is no appreciable additional thickness or hard spot in this region that might serve as a source of irritation to the foot. To achieve this kind of closure, the textile technique known as "linking" may be employed for joining the toe sections together and closing them, using the same yarns as are incorporated in those areas of the socks. Linking machines of any make could be used, so long as the "linker gauge" is compatible with the gauge of the sock. Either a double chain over stitch or a single chain stitch could be used. A "single chain stitch" may be advisable as it is simpler and occupies minimum space.

What is claimed is:

1. A sock comprising:

(a) a first inner ply of knit construction inserted within a second, outer ply of knit construction, said inner ply having a first surface made of material that is sufficiently hydrophobic to comprise means for carrying moisture away from the skin of a wearer, which is capable of relatively high friction with the skin of the wearer and a second surface having relatively low frictional characteristics, said second ply having a first surface positioned adjacent the second surface of said first ply and having relatively low frictional characteristics and also having a second surface having relatively high friction characteristics and being formed of a material which is sufficiently hydrophilic to comprise means for holding normal amounts of perspiration from the skin of the wearer.

2. The sock according to claim 1 wherein said two plies were formed in a continuous knitting operation.

3. The sock according to claim 1 wherein said inner ply is made of materials which are hydrophobic and wherein the first surface of said outer ply is also made of materials which are hydrophobic.

4. The sock according to claim 1 wherein the toe portions of said first and second plies are joined together.

5. The sock according to claim 1 wherein the upper edges of said inner and outer plies are joined together.

6. The sock according to claim 1 wherein the material of said first ply and of the first surface of said outer ply have high thermal conductivity.

7. The sock according to claim 1 wherein said inner ply is slightly smaller than said outer ply.

8. A knit sock comprising a foot portion which includes:

(a) a first inner ply of knit construction which includes:

(1) a first surface adapted to be positioned in contact with the skin of the wearer and formed principally of yarns having high thermal conductivity, low moisture regain in sufficiently hydrophobic material to comprise means for carrying moisture away from the skin of a wearer, and being frictionally cohesive with the skin, and (2) a second, opposed surface formed principally of yarns having frictional characteristics substantially lower than the frictional characteristics of said first surface, (b) a second outer ply of knit construction which includes:

(1) a first surface positioned adjacent the second surface of the first ply and also having low frictional characteristics relative to said first surface of said first ply, and (2) a second opposed surface formed of yarns having relatively high frictional characteristics and having high moisture regain in sufficiently hydrophilic material to comprise means for holding normal amounts of perspiration from the skin of a wearer, said inner ply being slightly smaller than said outer ply to enable it to be inserted within said outer ply.

9. The sock according to claim 1 wherein said first and second plies have their technical faces disposed facing one another, said technical faces providing said surfaces having relatively low frictional characteristics.

10. The sock according to claim 1 wherein said facing surfaces have frictional characteristics of about 2.65 grams per square centimeter or lower as measured under the test conditions set forth herein.

11. The sock according to claim 1 wherein the surfaces of the plies adapted to be disposed next to the skin and next to the interior of the shoe have frictional characteristics of about 19 grams per square centimeter and higher against rubber as measured under the test conditions set forth herein.

* * * * *

UNITED STATES PATENT AND TRADEMARK OFFICE

CERTIFICATE OF CORRECTION

PATENT NO. : 4,615,188

DATED : October 7, 1986

INVENTOR(S) : Hursh et al.

It is certified that error appears in the above—identified patent and that said Letters Patent is hereby corrected as shown below:

Column 2, line 51: "arm" should be --arms--.

Column 2, line 58: "hydropholic" should be --hydrophobic--.

Column 4, line 40: "in" should be --is--.

Signed and Sealed this

Twenty-third Day of December, 1986

*Attest:*

DONALD J. QUIGG

*Attesting Officer* *Commissioner of Patents and Trademarks*